US005987279A

United States Patent [19]

Ebata

[11] Patent Number: 5,987,279

[45] Date of Patent: Nov. 16, 1999

[54] IMAGE FORMING APPARATUS

[75] Inventor: Yasuhiro Ebata, Kanagawa-ken, Japan

[73] Assignee: Kabushiki Kaisha Toshiba, Kawasaki, Japan

[21] Appl. No.: 09/158,287

[22] Filed: Sep. 22, 1998

[30] Foreign Application Priority Data

Sep. 22, 1997 [JP] Japan ..... 9-256840

[51] Int. Cl.[6] ..... G03G 21/16

[52] U.S. Cl. ..... 399/113; 399/21; 399/364

[58] Field of Search ..... 399/113, 110, 399/320, 364, 374, 21

[56] References Cited

U.S. PATENT DOCUMENTS 4,165,168 8/1979 Baumann et al. .
4,782,359 11/1988 Tomoe .
5,049,945 9/1991 Fukano et al. .
5,749,027 5/1998 Ikemoto et al. ..... 399/113
5,873,012 2/1999 Miyabe et al. ..... 399/111 X

FOREIGN PATENT DOCUMENTS 8-73117 3/1996 Japan .

*Primary Examiner*—Richard Moses
*Attorney, Agent, or Firm*—Foley & Lardner

[57] ABSTRACT

An image forming apparatus of the present invention includes a main body, a fixing device arranged in the main body and supported so that it can be pulled out of the main by for fixing an image formed on one side of a paper, a duplex device arranged in the main body and supported so that it can be pulled out of the main body for once housing a paper having an image fixed on one side and taking it out with the other side having no image fixed facing toward the fixing device; and a coupling unit for coupling so that the fixing device and the duplex device can be pulled out of the main body simultaneously.

20 Claims, 4 Drawing Sheets

IMAGE FORMING APPARATUS

BACKGROUND OF THE INVENTION

1. Field of the Invention

The present invention relates to an image forming apparatus, which serves as an electronic copying machine, equipped with a duplex device enabling the copying of both sides of a paper.

2. Description of the Related Art

There is a model of an image forming apparatus, which is an electronic copying machine, provided with a so-called duplex copying function to copy an image on one side of a paper and then, copy another image on the other side.

This kind of an image forming apparatus is equipped with an automatic duplex device which takes a paper with a developer image fixed on one side by a fixing device once via an auxiliary conveying path, inverse it to change its fixing side and carrying it out again between a photo-conductive drum and a transfer charger.

To be concrete, there is a converting (sorting) gate between a fixing device and a paper receiving tray and this paper receiving tray is arranged at one of the sorted destinations and the automatic duplex device is arranged at the other sorted destination via the auxiliary conveying path.

An electronic copying machine equipped with such the automatic duplex device adopts such a structure that, in order to suppress the increase in the installing space of the main body, the automatic duplex device is arranged almost immediately below the fixing device and these fixing device and the automatic duplex device are connected each other by the auxiliary conveying path.

The auxiliary conveying path is formed in a sharp curved state so as to convey a paper almost in a U-turn state. As a result, such a phenomenon called a jam that a paper is jammed in the auxiliary conveying path tends to be caused.

As the indication of "JAM" is shown on the operation panel at this time, worker is required to remove a jammed paper. Actually, the length of the auxiliary conveying path is shorter than that of a paper and a part of a paper left in the auxiliary conveying path and the remainder of the paper is left in the fixing device and/or the automatic duplex device.

The fixing device and the automatic duplex device are so arranged that they can be pulled cut of the main body, while the auxiliary conveying path comprising conveyor rollers and guide plates is fixed to the main body.

So, worker pulls out the fixing device or the automatic duplex device to this side and remove a jammed paper or takes out the jammed paper by inserting his hand into the main body and takes out the jammed paper without pulling out the devices.

However, even when the fixed device and the automatic duplex device are pulled out, as a part of a paper is left in the auxiliary conveying path in the main body, the paper tends to be cut in the main body. If so, the portion of the paper left in the main body must be taken out and it becomes very troublesome to take out the paper left in the main body.

If the hand is inserted into the main body from the first or later, the inside of the main body is not visible and there is the possibility that the hand may touch other component elements and is injured or other component elements may be damaged.

Further, there are some models in which a fixing device and an automatic duplex device are arranged in series along a paper conveying path and an auxiliary conveying path is omitted. Even in this case, such devices are separately taken out if a paper is jammed and there are the same problems as shown above.

SUMMARY OF THE INVENTION

It is an object of the present invention to provide an image forming apparatus which assures the safe and fast removing of a paper when jammed between a fixing device and an automatic duplex device, thus improving the workability and safety and securing reliability of the apparatus.

According to the present invention, an image forming apparatus is provided. The image forming apparatus comprises a main body; a fixing device arranged in the main body for fixing an image formed on one surface of a paper, the fixing device being supported so that it can be pulled out of the main body; a duplex device arranged in the main body for once housing paper having a fixed image on one surface and conveying with the other surface having no fixed image faced toward the fixing device, the duplex device being supported so that it can be pulled out of the main body; and coupling means for coupling the fixing device and the duplex device so that they can be simultaneously pulled out of the main body.

DETAILED DESCRIPTION OF THE PREFERRED EMBODIMENTS

Hereinafter, a preferred embodiment of an image forming apparatus of the present invention will be described with reference to the attached drawings.

Figure 1:
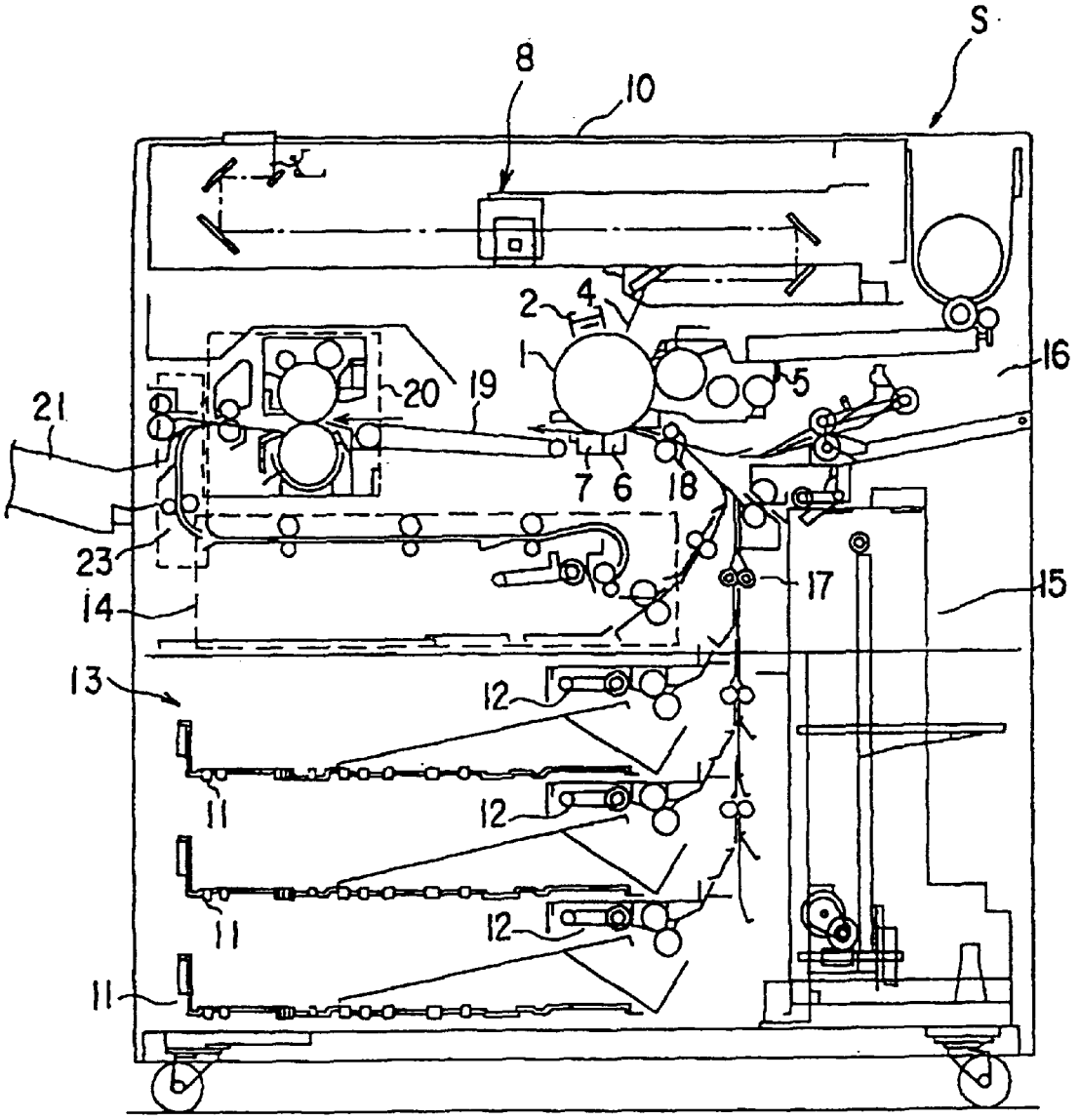
FIG. 1 is a schematic diagram showing the entire structure of an electronic copying machine which serves as an image forming apparatus to-which the present invention is applied.

FIG. 1 shows an electronic copying machine which serves as an image forming apparatus. A photo-conductive drum 1 which serves as an image carrier is arranged in a main body S. This photo-conductive drum 1 is connected to a driving source (not shown).

Around the photo-conductive drum 1, there are arranged a main charger 2, an exposing portion 4, a developing device 5, a transfer charger 6, a separation charger 7, a cleaning device (not shown) and a charge elimination lamp (not shown) along the rotating direction of the photo-conductive drum 1.

On the top of the main body S of the copying machine, a document table 10 comprising a glass plate for placing documents is provided and an optical unit 8 is arranged between the document table 10 and the exposing portion 4.

On the bottom of the main body S, a paper supply device 13 is arranged. The paper supply device 13 is composed of a plurality of cassettes 11, each of which is for containing paper in different sizes, and a paper supply belt 12.

On the top of the uppermost cassette of the paper supply device 13, an automatic duplex unit (hereinafter referred to as ADU) 14 is arranged. At the sides of these ADU 14 and the paper supply device 13, a large capacity cassette 15 is arranged and on the top of this large capacity cassette 15, a manual paper supply device 16 is arranged.

At the paper supply side of each cassette 11 of the paper supply device 13, the ADU 14, the large capacity cassette 15 and the manual paper supply device 16, a paper conveying device 17 is arranged. The paper conveying device 17 conveys paper supplied from the cassette 11, the ADU 14, the large capacity cassette 15 or the manual paper supply device 16 to an aligning roller pair 18 which is arranged at the lower side of the developing device 5. At the paper conveying side of the aligning roller pair 18, the transfer charger 6 is arranged.

Figure 2:
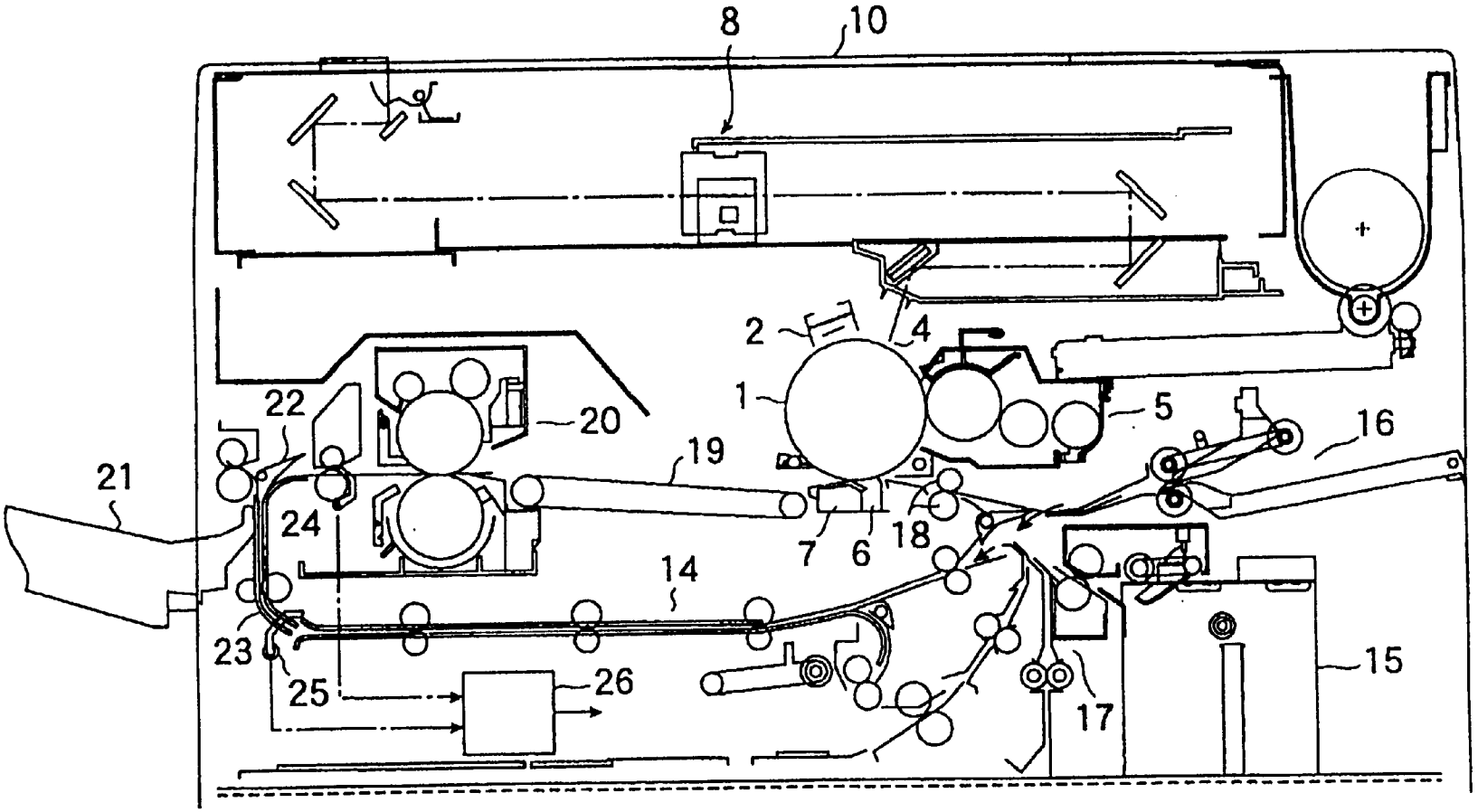
FIG. 2 is a partially enlarged schematic diagram of the electronic copying machine shown in FIG. 1.

As shown in the enlarged view of FIG. 2, at the side of the separation charger 71 a conveyor belt 19 is arranged to convey paper. At the conveying end of the conveyor belt 19, a fixing device 20 is arranged and further, on the side of the main body, a paper receiving tray 21 is mounted.

Between the paper receiving tray 21 and the fixing device 20, a converting gate 22 is provided. The paper receiving tray 21 is arranged at one of the sorted destination of the converting gate 22 and the ADU 14 is provided at the other sorted destination via an auxiliary conveying path 23.

Between the fixing device 20 arranged at the inlet side of the auxiliary conveying path 23 and the converting gate 22, a first paper jam detector 24 is arranged and at the inlet side of the ADU 14 provided at the outlet side of the auxiliary conveying path 23, a second paper jam detector 25 is arranged.

The first and the second paper jam detectors 24 and 25 are electrically connected to a controller 26 and further, electrically connected to an operation panel (not shown) from the controller 26.

When judged the paper jam, the controller 26 indicates such a message as, for instance, "PAPER JAMMED IN U-TURN SECTION AT EXIT SIDE. PULL OUT THE KNOB AND PROCESS JAMMED PAPER." or "PAPER JAMMED. PULL OUT KNOB THAT IS LIGHTED AND PROCESS JAMMED PAPER." on the operation panel.

Figure 3:
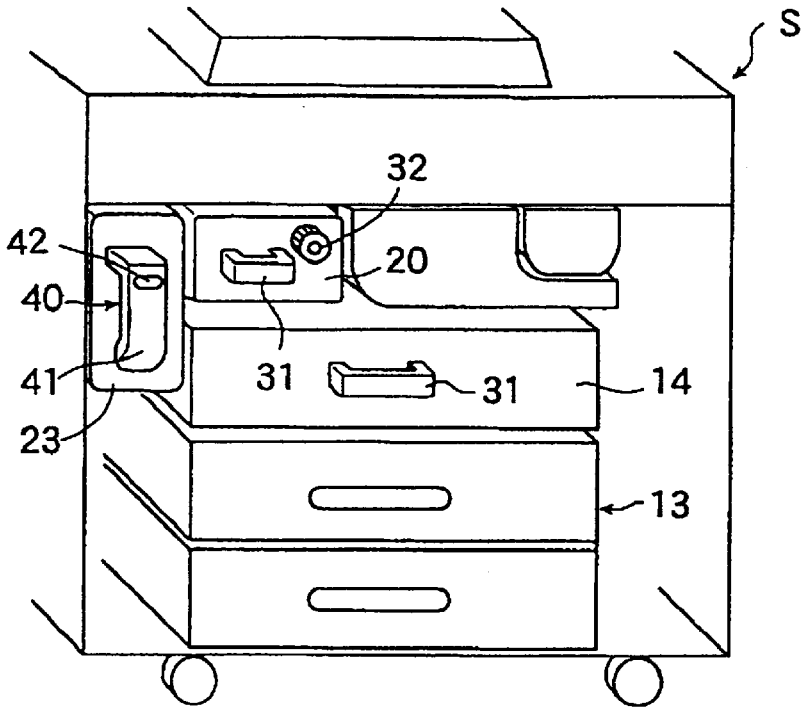
FIG. 3 is a perspective view of a fixing device, an automatic duplex device and an auxiliary conveying path arranged in the inside of the electronic copying machine shown in FIG. 1.
Figure 4:
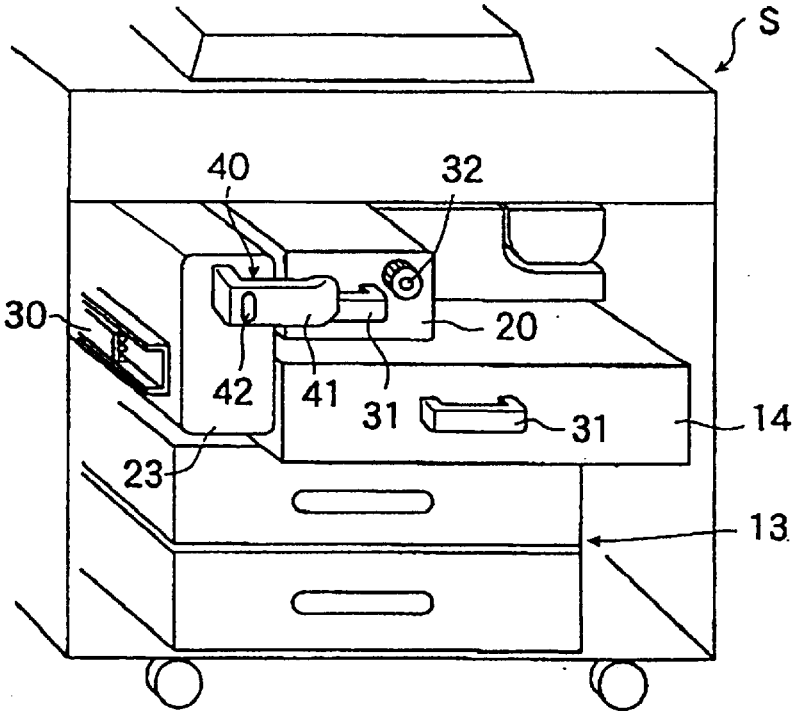
FIG. 4 is a perspective view showing the state of the fixing device, automatic duplex device and auxiliary conveying path pulled out of the main body shown in FIG. 3.

As shown in FIG. 3 and FIG. 4, when the front cover of the main body of the apparatus is opened, the modular units of fixing device 20, auxiliary conveying path 23 and ADU 14 can be seen.

The paper supply device 13, the photo-conductive drum 1 and the main charger 2 are also made modular units, respectively; moreover the detailed explanation will be omitted here.

The fixing device 20, the auxiliary conveying path 23 and the ADU 14 are supported movably on a guide rail 30 that is provided along the longitudinal direction of the main body S. That is, they can be pulled out to this side (the front surface side) from the main body S along the guide rail 30.

A handle 31 is mounted on the front panels of the fixing device 20 and the ADU 14, respectively. These handles 31 are used when performing the maintenance of the fixing device 20 and the ADU 14.

On the front panel of the fixing device 20 only, a dial 32 for the jam processing is provided. This dial is connected mechanically to a specified conveyor roller arranged in the fixing device so as to eject a jammed paper to the outside by manually rotating this dial when processing the jammed paper.

On the front panel of the auxiliary conveying path 23, a knob 41 comprising a coupling mechanism 40 that is described later is mounted. One end of the knob 41 is pivoted on the front panel and the other end is a free end and is able to freely rotate. At the end of the pivoted side, there is provided an indicator 42 such as an LED which is connected to the controller 26, comprising an informing means jointly with an indicator on the operation panel.

Figure 5:
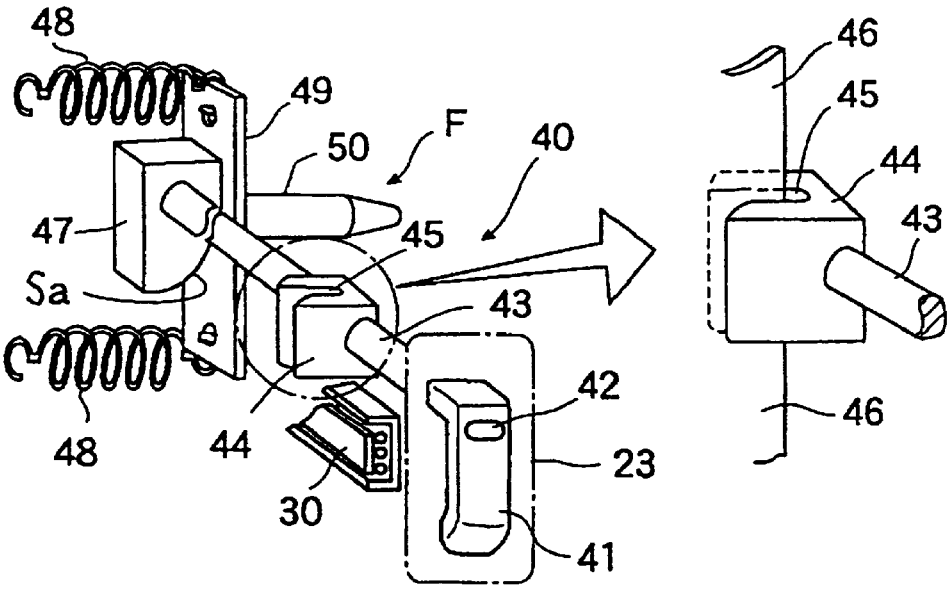
FIG. 5 is a perspective view showing a coupling mechanism that is applied to an image forming apparatus of the present invention.

As shown in FIG. 5, the knob 41 is supported rotatably on the front panel of the auxiliary conveying path 23. A shaft 43 connected to the rotating end of the knob 41 is extended toward the rear surface of the auxiliary conveying path 23.

At the middle section of the shaft 43, a positioning member 44 is provided. This positioning member 44 is a rectangular dowel member and a slit 45 is provided at its one side. The slit 45 of the positioning member 44 engages with a frame 46 that is projecting from the main body S in the normal state where the free end of the knob 41 hangs down. In this engaged state, the coupling mechanism 40 and the longitudinal position of the auxiliary conveying path 23 are controlled.

Figure 6:
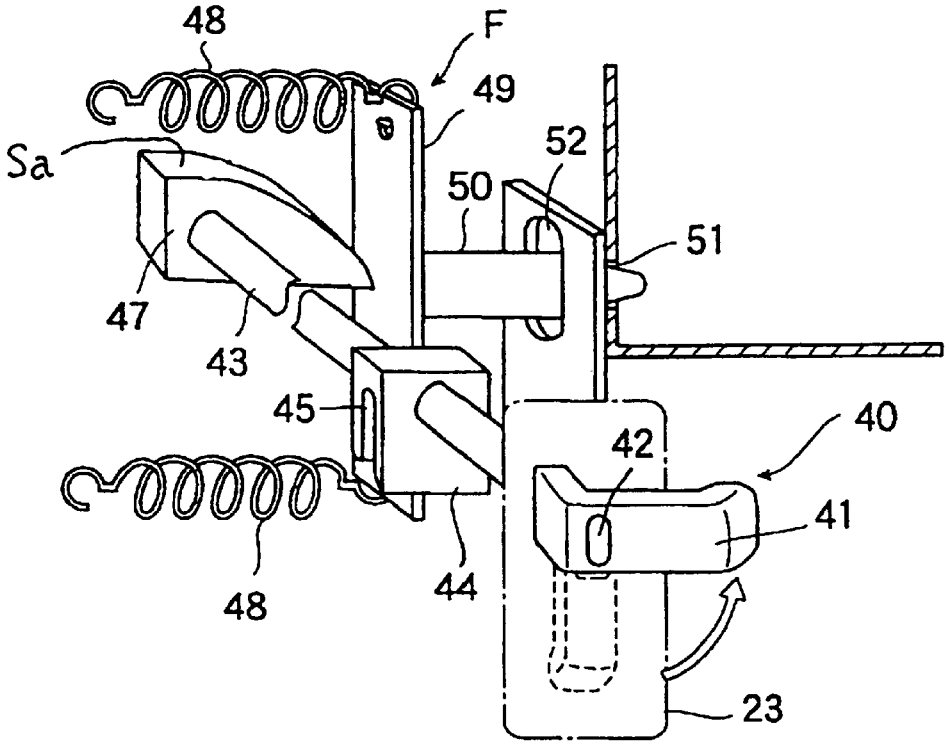
FIG. 6 is a perspective view showing the operation of the coupling mechanism shown in FIG. 5.

As shown in FIG. 6, the auxiliary conveying path 23 is able to change its position in the longitudinal direction freely together with the coupling mechanism 40 only when the slit 45 of the positioning member 44 is separated from the frame 46 of the main frame by rotating the knob 41 in the direction of arrow.

As shown in FIG. 5 and FIG. 6, a pressuring member 47 having a curved surface Sa which is partially formed in the circular arc shape is provided at the other end of the shaft 43. This pressuring member 47 is in a right angled triangle in the prescribed plate thickness, its side equivalent to the oblique side is the curved surface Sa and the shaft 43 penetrates near the right angle portion soft the pressuring member 47.

The curved surface Sa of the pressuring member 47 is kept in contact with a hook plate 49 at which upper and lower ends a tension spring 48 hooked, respectively. The other end of each tension spring 48 hooks at the prescribed portion of the auxiliary conveying path 23.

In the normal state where the free end of the knob 41 is hanging down, the hook plate 49 is elastically compressed by the elastic force of the pressuring member 47 so as to contact a point near the top of the curved surface Sa. When the knob 41 is rotated against the elastic force of the tension spring 48, the tip of the curved surface Sa of the pressuring member 47 is displaced to contact the hook plate 49 against the elastic force of the tension spring 48 and thus, the hook plate is displaced. When the knob 41 is rotated in the original direction even slightly, the elastic force of the tension spring 48 acts again to return the knob 41 to the prescribed state automatically.

A hook 50 having a sharp shaped tip is projected from the hook plate 49. This tip of the hook 50 is inserted into holes 51 and 52 provided on the fixing device 20 and the ADU 14, respectively when the hook plate 49 is displaced by the pressuring member 47. In the state where the hook plate 49 returned to the original position, the tip of the hook 50 comes out of the holes 51 and 52 and has no longer related to each other.

Thus, a hook mechanism F is composed of parts ranging from the shaft 43 to the hook 50 excepting the knob 41.

When a document is set on the document table 10 and the copy switch is turned ON, the optical unit 8 exposes and scans the document surface and a document image is formed on the surface of the photo-conductive drum 1 in the exposing portion 4.

The surface of the photo-conductive drum 1 is charged previously by the main charger 2 and the document image is formed in an electrostatic latent image. When the photo-conductive drum 1 is rotated and the electrostatic latent image portion faces the developing device 5, a developer is supplied from the developing device 5 and the latent image is developed.

Further, simultaneously with the start of copying, a paper designated by, for instance, the paper supply device 13 is supplied via the paper conveying device. If the supply of paper from the large capacity cassette 15 is designated, as a matter of course, a paper is supplied from the large capacity cassette 15.

A supplied paper is conveyed between the photo-conductive drum 1 and the transfer charger 6 timely by the aligning roller pair 18 and a developer image is transferred on the top of the paper by the transfer charger 6.

The paper with the developer image transferred on its top is separated from the photo-conductive drum 1 by the action of the separation charger 7 and conveyed on the conveyor belt 19. Then, the paper is led to the fixing device 20 wherein the image is fixed and the paper with the developer image fixed on its top is ejected in the paper receiving tray 21.

The photo-conductive drum 1 continues to rotate successively. The area from where the paper was separated by the separation charger 7 is faced to the cleaning device and a residual toner is wiped and removed from the drum surface, discharged by the charge elimination lamp and is faced to the main charger again and the actions described above are repeated.

The duplex copying is executed as shown below when it is directed.

That is, the processes from when a paper is led to the fixing device 20 until a fixed image is obtained on its top surface are the same as described above.

Under this state, the converting gate 22 is displaced so as to lead the paper with the fixed image obtained on its top surface to the auxiliary conveying path 23. So, this paper is led to the ADU 14 by way of the auxiliary conveying path 23.

The ADU 14 is located under the fixing device 20 and the auxiliary conveying path 23 is formed almost in the U-shaped state and therefore, when the paper is led to the auxiliary conveying path 23, its fixed image surface is faced to the paper receiving tray 21 side.

When this paper is led to the ADU 14, the fixed image surface is faced downward. Under this state, the paper is conveyed from one end to the other end in the ADU 14 and further, when conveyed in the U-turn state, it is housed in the bottom of the apparatus. At this time, the fixed image surface is faced upward and the non-fixed image surface comes to the down side.

After paper in the number of sheets designated for the duplex copying are housed in the ADU 14 successively and accumulated, the image forming on the non-fixing image surface is carried out.

First, the ADU 14 acts to supply accumulated paper. This paper is led to the aligning roller pair 18 by way of the paper conveying device 17, where the paper is aligned and timely supplied between the photo-conductive drum 1 and the transfer charger 6.

As the ADU 14 is located immediately below the photo-conductive drum 1, the paper is conveyed in the U-turn state. Accordingly, even if the fixed image surface is at the upper side and the non-fixed image surface is at the lower side when carried out from the ADU 14, the paper is reversed when supplied to the photo-conductive drum 1 so that the non-fixing image surface comes to the upper side and the fixed image surface comes to the lower side.

A developer image that is developed is transferred on the upper surface side of a paper by the transfer charger 6. That is, a developer image is formed on the surface that has so far no fixed image. The paper having a transferred developer image is led to the fixing device 20 again and the image is fixed and is ejected in the receiving tray 21 in the two side copied state.

While the duplex copying is functioning, the first paper jam detector 24 detects the leading edge of a paper conveyed from the fixing device 20. Further, the second paper jam detector 25 detects the trailing edge of a paper that is conveyed on the auxiliary conveying path 23 and is introducing into the ADU 14.

The controller 26 counts a time from the detection of the leading edge of a paper by the first paper jam detector 24 to the detection of the trailing edge of a paper by the second paper jam detector 25 and computes whether this counted time is within the predetermined time.

If the time detected by the first and the second paper jam detectors 24 and 25 is above the prescribed time, the controller 6 judges that the paper jam was taken place in the auxiliary conveying path 23, stops a series of copying actions, makes an applicable indication and lights the indicator 42 provided at the knob 41 of the coupling mechanism 40.

Worker performs the works according to the indications on the operation panel. That is, the front panel of the main body S is opened by worker. As the indicator 42 of the knob 41 is already ON, worker is able to check which knob should be rotated easily.

As shown in FIG. 5, when the knob 41 of which free end faces downward is rotated counterclockwise by 90° as shown in FIG. 6, the hook mechanism F connected to the knob 41 is engaged with the fixing device 20 and the ADU 14.

When the knob 41 is pulled out by worker to this side without changing its position, the fixing device 20 and the ADU 14 are pulled out to this side together with the auxiliary conveying path provided with the coupling mechanism 40.

Even when a part of the paper jammed in the auxiliary conveying path 23 is in the fixing device 20 or the ADU 14, the paper is pulled out in the jammed state. So, by rotating, for instance, the dial 32, worker takes out the jammed paper.

The jammed paper can be taken out certainly without leaving any of it in the main body S. Furthermore, as all the devices can be pulled out at one time and the easy work, the simple removal of a paper in the jammed state and high safety are assured.

After removing the jammed paper, when the knob 41 is pushed back into the main body S by grasping it without changing its posture, the auxiliary conveying path 23, the fixing device 20 and the ADU 14 move simultaneously and return to the prescribed positions, respectively.

When the knob 41 is restored in the original state and the front panel is closed, the duplex copying function starts again.

Further, in the above embodiment, a paper is conveyed in the U-turn state by providing the auxiliary conveying path 23 between the fixing device 20 and the ADU 14; however, it is not limited to this and needless to say, this invention is also applicable to an electronic copying machine in which the fixing device 20 and the ADU 14 are arranged in series along a paper conveying path.

As described above, according to the present invention, it is possible to get such effects that the work to remove a paper jammed between the fixing device and the ADU 14 can be made safely and quickly and thus, workability and safety are improved and reliability is secured.

What is claimed is:

1. An image forming apparatus comprising:

a main body;

a fixing device arranged in the main body for fixing an image formed on one surface of a paper, the fixing device being supported so that it can be pulled out of the main body;

a duplex device arranged in the main body for once housing paper having a fixed image on one surface and conveying with the other surface having no fixed image faced toward the fixing device, the duplex device being supported so that it can be pulled out of the main body; and coupling means for coupling the fixing device and the duplex device so that they can be simultaneously pulled out of the main body.

2. An image forming apparatus as set forth in claim 1; wherein the coupling means includes a freely rotatable knob and a hook mechanism connected to the knob and can be connected/disconnected to/from the fixing device and the duplex device.

3. An image forming apparatus as set forth in claim 1, further comprising:

a rail to support the fixing device and the duplex device so that they can be pulled out of the main body to this side.

4. An image forming apparatus as set forth in claim 1, further comprising:

a first paper jam detector provided at the outlet side of the fixing device for detecting the leading edge of a paper;

a second paper jam detector provided at the inlet side of the duplex device for detecting the trailing edge of the paper; and means for judging that the paper is jammed when a time from the detection of the leading edge of the paper by the first paper jam detector to the detection of the trailing edge of the paper by the second paper jam detector is above a specified time.

5. An image forming apparatus as set forth in claim 4, wherein the paper jam judging means is further included an informing means to inform the paper jam when so judged.

6. An image forming apparatus as set forth in claim 5; wherein the paper jam informing means is provided in the main body and the coupling means.

7. An image forming apparatus comprising:

a main body;

a fixing device arranged in the main body for fixing an image formed on one surface of a paper, the fixing device being supported so that it can be pulled out of the main body;

a duplex device arranged in the main body for once housing a paper having a fixed image on one surface and for conveying the surface of the paper with no image to the fixing device, the duplex device being supported so that it can be pulled out of the main body;

an auxiliary conveying path arranged between the fixing device and the duplex device for inverting the paper with an image fixed on one surface by the fixing device and convey and guide the paper to the duplex device, the auxiliary conveying path being supported so that it can be pulled out of the main body; and coupling means for coupling the fixing device, the auxiliary conveying path and the duplex device so as to pull out them simultaneously from the main body.

8. An image forming apparatus as set forth in claim 7, wherein the coupling means includes a rotatable knob provided in the auxiliary conveying path and a hook mechanism that can be connected/disconnected to/from the fixing device and the duplex device connected to the knob.

9. An image forming apparatus as set forth in claim 7, wherein a paper jam detector is provided at the inlet and outlet side of the auxiliary conveying path for detecting the paper jam.

10. An image forming apparatus as set forth in claim 9, wherein the paper jam detectors are including:

a first paper jam detector provided at the outlet side of the fixing device corresponding to the inlet side of the auxiliary conveying path for detecting the leading edge of the paper;

a second paper jam detector provided at the inlet side of the duplex device corresponding to the outlet side of the auxiliary conveying path for detecting the trailing edge of the paper; and means for judging the paper jam if a time from the detection of the leading edge of the paper by the first paper jam detector to the detection of the trailing edge of the paper by the second jam detector is above a specified time.

11. An image forming apparatus as set forth in claim 7, further comprising:

a rail supporting the fixing device, the auxiliary conveying path and the duplex device so that they can be pulled out of the main body to this side.

12. An image forming apparatus as set forth in claim 10, wherein the paper jam judging means further includes a means to inform the paper jam when so judged.

13. An image forming apparatus as set forth in claim 12, wherein the informing weans is provided at the main body and the coupling means.

14. An image forming apparatus comprising:

a main body;

a fixing device arranged in the main body for fixing an image formed on one side of a paper, the fixing device being supported so that it can be pulled out of the main body;

a converting gate arranged at the paper take-out side of the fixing device for sorting and guiding paper in two directions;

a duplex device arranged in the main body for once housing a paper having an image fixed on one side and taking out the paper with the other surface having no image fixed to the fixing device, the duplex device being supported so that it can be pulled out of the main body;

an auxiliary conveying path arranged at one of the sorted destinations and between the fixing device and the duplex device for inverting a paper with an image fixed on one side by the fixing device, taking and guiding the paper to the duplex device, the auxiliary conveying path being supported so that it can be pulled out of the main body; and coupling means for coupling the fixing device, the auxiliary conveying device and the duplex device so that they can be pulled out of the main body simultaneously.

15. An image forming apparatus as set forth in claim 14, wherein the coupling means includes a rotatable knob provided in the auxiliary conveying path and a hook mechanism that can be connected/disconnected to/from the fixing device and the duplex device connected to this knob.

16. An image forming apparatus as set forth in claim 14, wherein a paper jam detector is provided at the inlet and the outlet sides of the auxiliary conveying path for detecting the paper jam, respectively.

17. An image forming apparatus as set forth in claim 16, wherein the paper jam detectors are including:

a first paper jam detector provided at the outlet side of the fixing device corresponding to the inlet side of the auxiliary conveying path for detecting the leading edge of a paper;

a second paper jam detector provided at the inlet side of the duplex device corresponding to the outlet side of the auxiliary conveying path for detecting the trailing edge of a paper; and means for judging the paper jam if a time from the detection of the leading edge of a paper by the first paper jam detector to the detection of the trailing edge of a paper by the second jam detector is above a specified time.

18. An image forming apparatus as set forth in claim 14, further comprising:

a rail supporting the fixing device, the auxiliary conveying path and the duplex device so that they can be pulled out of the main body to this side.

19. An image forming apparatus as set forth in claim 17, wherein the paper jam judging means further includes a means to inform the paper jam when so judged.

20. An image forming apparatus as set forth in claim 19, wherein the informing means is provided at the main body and the coupling means.

* * * * *